US005826132A

United States Patent [19]

Damji et al.

[11] Patent Number: 5,826,132

[45] Date of Patent: Oct. 20, 1998

[54] VARIABLE SIZE, REPLACEABLE TONER SUMP PANS FOR PRINT CARTRIDGES

[75] Inventors: Dhirendra C. Damji, Webster; Ajay Kumar, Fairport, both of N.Y.

[73] Assignee: Xerox Corporation, Stamford, Conn.

[21] Appl. No.: 971,690

[22] Filed: Nov. 17, 1997

[51] Int. Cl.[6] ..... G03G 15/00; G03G 21/18

[52] U.S. Cl. ..... 399/110; 399/111; 399/113; 399/119

[58] Field of Search ..... 399/109, 110, 399/111, 119, 120, 113; 220/629, 4.21; 222/DIG. 1, 325

[56] References Cited

U.S. PATENT DOCUMENTS

| | | | |
|---|---|---|---|
| 2,338,397 | 1/1944 | Beasley | 220/4.21 |
| 4,797,704 | 1/1989 | Williams et al. | 399/119 |
| 5,083,166 | 1/1992 | Hill et al. | 399/119 |
| 5,223,668 | 6/1993 | Takaya et al. . | |
| 5,294,960 | 3/1994 | Nomura et al. | 399/113 |
| 5,543,898 | 8/1996 | Shishido et al. . | |
| 5,557,381 | 9/1996 | Sakamoto et al. | 399/111 |
| 5,617,188 | 4/1997 | Inomata | 399/13 |
| 5,778,283 | 7/1998 | Damji et al. | 399/111 |
| 5,778,284 | 7/1998 | Kumar et al. | 399/111 |
| 5,784,671 | 7/1998 | Damji et al. | 399/110 |

*Primary Examiner*—Matthew S. Smith
*Attorney, Agent, or Firm*—John S. Wagley

[57] ABSTRACT

A system for providing a plurality of process cartridges for developing with marking particles a latent image with common components is provided. The system includes a housing and a member mounted to the housing for advancing the marking particles toward the latent image. The system also includes a first pan securable to the housing and defining a first cavity therebetween. The first cavity defines a first volume. The system also includes a second pan securable to the housing and defining a second cavity therebetween. The second cavity defines a second volume substantially different than the first volume. The housing, the member and the first pan are assemblable to form a first process cartridge including the first volume. The housing, the member and the second pan are assemblable to form a second process cartridge including the second volume.

21 Claims, 11 Drawing Sheets

VARIABLE SIZE, REPLACEABLE TONER SUMP PANS FOR PRINT CARTRIDGES

RELATED CASES

Cross reference is made to the following applications filed concurrently herewith: Attorney Docket Number D/97267 entitled "Pin Charge Corotron With Optimum Dimensions For Minimum Ozone Production" by Dhirendra C. Damji et al., Attorney Docket Number D/97268 entitled "Development Bias Connector With Integral Bearing Support" by Dhirendra C. Damji et al., Attorney Docket Number D/97329 entitled "Charging Device Module For Use With Print Cartridge" by Ajay Kumar et al., Attorney Docket Number D/97329Q1 entitled "Charging Device Having An Electrode With Integral Electrical Connector" by Ajay Kumar et al., Attorney Docket Number D/97329Q2 entitled "Charging Device Having A Shield With Integral Electrical Connector" by Ajay Kumar et al., Attorney Docket Number D/97330 entitled "Process Cartridge Including Process Components Having Critical Image Quality And Life-Extending Process Path Acting Regions" by Dhirendra C. Damji et al., Attorney Docket Number D/97332 entitled "Molded Quick Change Photoreceptor Support" by Ajay Kumar et al., Attorney Docket Number D/97333 entitled "Printing Cartridge With Planar Drive Train" by Ajay Kumar et al., Attorney Docket Number D/97334 entitled "Process Cartridge Including A Handle Defining Part Of A Machine Paper Path" by Dhirendra C. Damji et al., Attorney Docket Number D/97351 entitled "Electrostatographic Process Cartridge Having A Non-Metallic Photoreceptor Grounding Pin " by Daniel A. Chiesa et al., Attorney Docket Number D/97352 entitled "Limited Life Electrostatographic Process Cartridge Having A Waste Toner Electro-Sump Subassembly" by Daniel A. Chiesa et al., Attorney Docket Number D/97353 entitled "Process Cartridge Having A Drive Assembly Resultant Force Counter-Acting Member" by Dhirendra C. Damji et al., Attorney Docket Number D/97354 entitled "Process Cartridge Including A Banding Defect Preventing Waste Toner Moving Auger" by Dhirendra C. Damji et al., Attorney Docket Number D/97355 entitled "Process Cartridge Including A Developer Housing Defining Part Of A Machine Paper Path" by Dhirendra C. Damji et al., Attorney Docket Number D/97357 entitled "All -In-One Process Cartridge Including A Photoreceptor And Process Components Having Relative Critical, Image Quality Acting Regions" by Dhirendra C. Damji et al., Attorney Docket Number D/97478 entitled "Printing Cartridge With Molded Cantilever Developer Roller Spacing Spring" by Ajay Kumar et al., and Attorney Docket Number D/97579 entitled "User Interface For An Electrostatographic Reproduction Machine" by Mark L. Leveto.

BACKGROUND

This invention relates to electrostatographic reproduction machines, and more particularly to an economical and capacity-extendible all-in-one process cartridge for easy adaptive use in a family of compact electrostatographic reproduction machines having different volume capacities and consumable life cycles. Specifically this invention relates to such a cartridge including a variable size, replaceable toner sump pans for print cartridges.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

A xerographic process cartridge or customer replaceable unit typically includes those components which most likely require service on a regular basis. For example, the CRU includes the photoconductive surface, cleaning blade, and charge corotron as well as the toner or marking particles.

Obviously, the process cartridge or CRU must be replaced when all the toner within the process cartridge has been used. It is preferable, therefore, to provide a quantity of toner within the process cartridge sufficient to account for the predictable life of other components within the process cartridge. For example, the process cartridge is designed to have a life and be replaced when the photoconductors needs replacement.

The photoconductor, as well as the cleaning blade and charge corotron typically do not include an immediate and dramatic failure such as when the toner within the cartridge has been spent. Print quality deteriorates slowly with the deterioration of the components of the process cartridge.

Therefore, customers may vary in the amount of toner that optimally should be provided in a process cartridge depending on the quality requirements of the customer. For a customer with high quality requirements, the photoconductor and consequently the process cartridge may require placements more frequently than that of a customer with less stringent quality requirements which may tolerate the lesser copy quality resulting from the longer than optimal use of a photoconductor.

Recently, printing machine manufacturers have provided alternate process cartridge that may be procured as a replacement to the process cartridge for a printing machine. These alternate process cartridges include a cartridge with a larger amount of toner to operate for a longer period of time and that with a smaller quantity of toner to operate for a lesser period of time. Copy quality, it should be appreciated, is higher for that cartridge having the smaller quantity of toner, in that the photoreceptor and other components are then changed more often.

The following disclosures may be relevant to various aspects of the present invention:

U.S. Pat. No. 5,223,668

Patentee: Takaya, et al.

Issue Date: Jun. 29, 1993

U.S. Pat. No. 5,543,898

Patentee: Shishido, et al.

Issue Date: Aug. 6, 1996

U.S. Pat. No. 5,617,188

Patentee: Inomata

Issue Date: Apr. 1, 1997

U.S. Pat. No. 5,223,668 discloses a developing device including a developer carrying member having a resistor layer. The developing device includes a developer housing that has an upper portion 6 and a lower portion 3.

U.S. Pat. No. 5,543,898 discloses a process cartridge that includes a first frame for containing developer, a second frame for supporting a developing apparatus and a third frame for supporting the image bearing member. All three frames are made of the same material.

U.S. Pat. No. 5,617,188 discloses a developing apparatus including a plurality of developing devices. Each device is provided with a containing portion for containing a developer and a carrying portion for carrying the developer.

SUMMARY OF THE INVENTION

In accordance with one aspect of the present invention, there is provided a system for providing a plurality of process cartridges for developing with marking particles a latent image with common components. The system includes a housing and a member mounted to the housing for advancing the marking particles toward the latent image. The system also includes a first pan securable to the housing and defining a first cavity therebetween. The first cavity defines a first volume. The system also includes a second pan securable to the housing and defining a second cavity therebetween. The second cavity defines a second volume substantially different than the first volume. The housing, the member and the first pan are assemblable to form a first process cartridge including the first volume. The housing, the member and the second pan are assemblable to form a second process cartridge including the second volume.

In accordance with another aspect of the present invention, there is provided a process cartridge for providing marking particles to develop a latent image for use in an electrostatographic printing device. The process cartridge includes a housing and a member mounted to the housing for advancing the marking particles toward the latent image. The process cartridge also includes one of a first pan and a second pan. The first pan is securable to the housing and cooperable with the housing to define a first cavity therebetween for storing the marking particles therein. The first cavity defines a first volume. The second pan is securable to the housing and cooperable with the housing to define a cavity therebetween for storing the marking particles therein. The second cavity defines a second volume substantially different than the first volume. The relative size and position of the housing, the member, the first pan and the second pan are selected so as to permit the process cartridge to advance the marking particles toward the latent image when either of the first pan and the second pan is utilized with the housing and the member.

In accordance with yet another aspect of the present invention, there is provided an electrophotographic printing machine of the type including a process cartridge for providing marking particles to develop a latent image. The process cartridge includes a housing and a member mounted to the housing for advancing the marking particles toward the latent image. The process cartridge also includes one of a first pan and a second pan. The first pan is securable to the housing and cooperable with the housing to define a first cavity therebetween for storing the marking particles therein. The first cavity defines a first volume. The second pan is securable to the housing and cooperable with the housing to define a cavity therebetween for storing the marking particles therein. The second cavity defines a second volume substantially different than the first volume. The relative size and position of the housing, the member, the first pan and the second pan are selected so as to permit the process cartridge to advance the marking particles toward the latent image when either of the first pan and the second pan is utilized with the housing and the member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
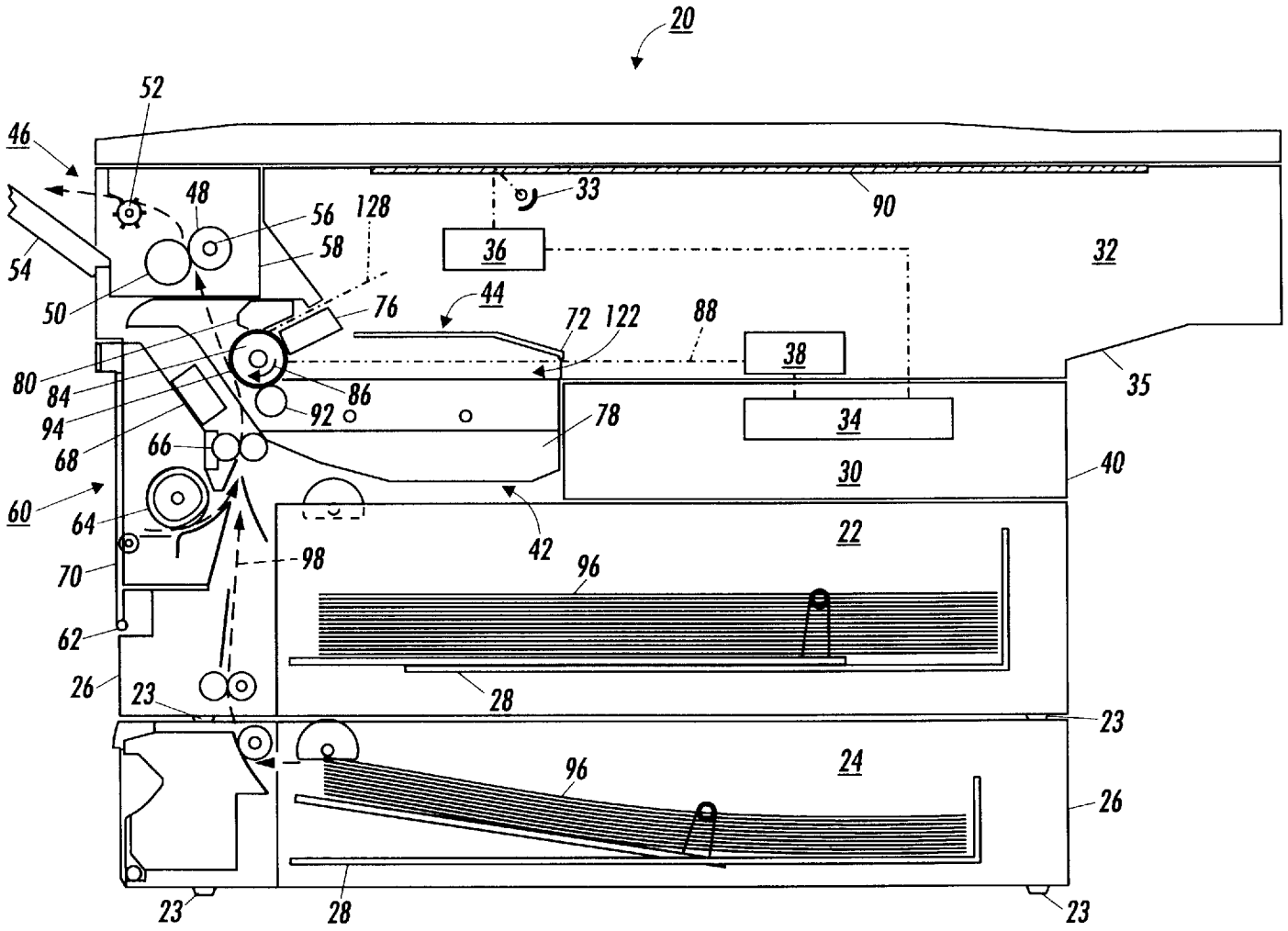
FIG. 1 is a front vertical illustration of an exemplary compact electrostatographic reproduction machine comprising separately framed mutually aligning modules in accordance with the present invention.
Figure 9:
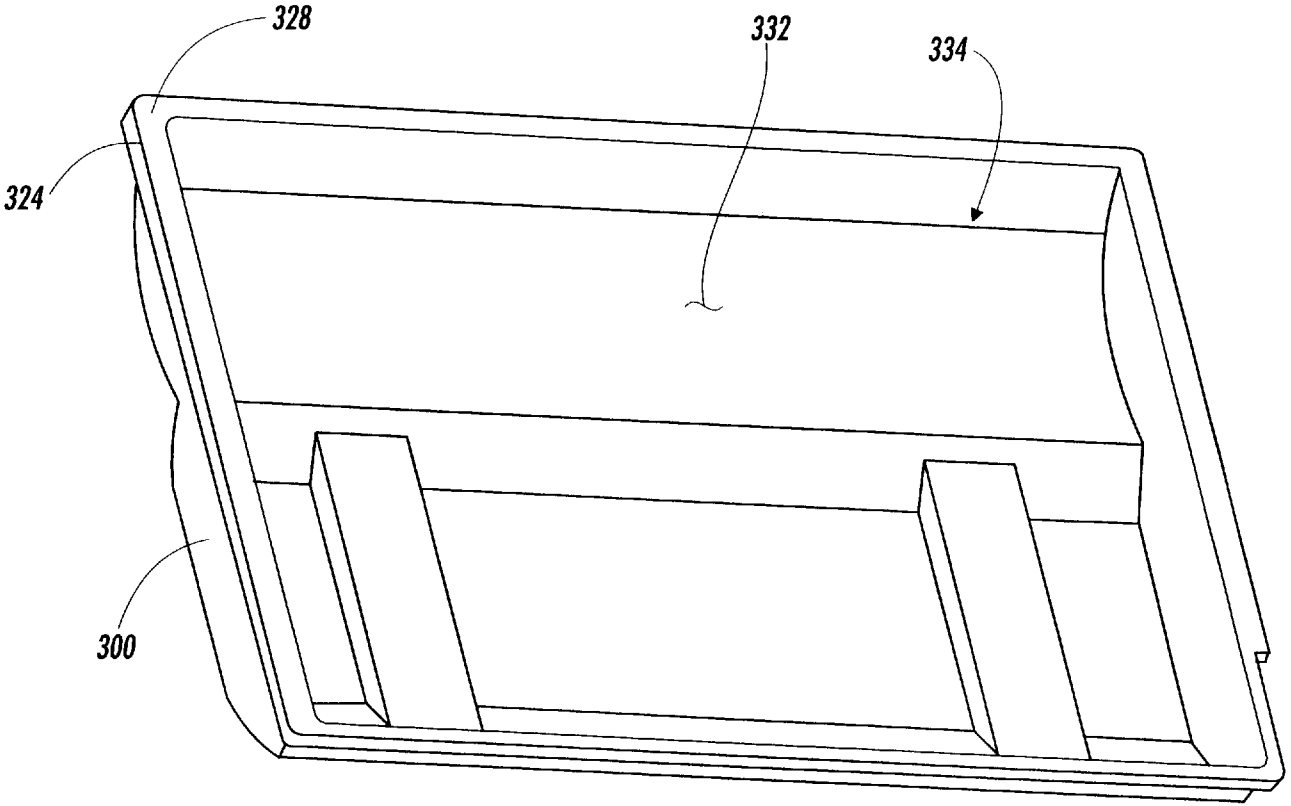
FIG. 9 is a perspective view of the inside of the variable size, replaceable toner sump pan of FIG. 7.

Referring now to FIGS. 1 and 9, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harness less interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles(not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The Door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 48, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the 20 final product, the machine 20.

Referring now to FIGS. 1–6, the CRU or process cartridge module 44 generally comprises a module housing subassembly 72, a photoreceptor subassembly 74, a charging subassembly 76, a developer subassembly 78 including a source of fresh developer material, a cleaning subassembly 80 25 for removing residual toner as waste toner from a surface of the photoreceptor, and a waste toner sump subassembly 82 for storing waste toner. The module housing subassembly 72 of the CRU or process cartridge module 44 importantly provides and includes supporting, locating and aligning structures, as well as driving components for the process cartridge module 44.

Still referring to FIG. 1, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The detailed and specific advantageous aspects of the structure and operation of the all-in-one CRU or process cartridge module 44, will now be described with particular reference to FIGS. 1 to 6. As shown, the all-in-one CRU or process cartridge module 44, generally includes six subassemblies comprising the module housing subassembly 72 (FIG. 2); the cleaning subassembly 80; the photoreceptor subassembly 74; the charging subassembly 76; the developer subassembly 78 (FIG. 3); and the waste toner sump subassembly 82. Generally, the function of the all-in-one CRU or process cartridge module 44 in the machine 20 is to electrostatically form a latent image, develop such latent image into a toner image through toner development, and transfer the toner image unfused onto a printing medium, such as a sheet of paper. The CRU or process cartridge module is left-side accessible to an operator facing the CIM 22 by opening the door module 60 (FIG. 1). Once the door module is opened, an operator or customer can remove or insert the CRU or process cartridge module 44 with one hand.

Figure 2:
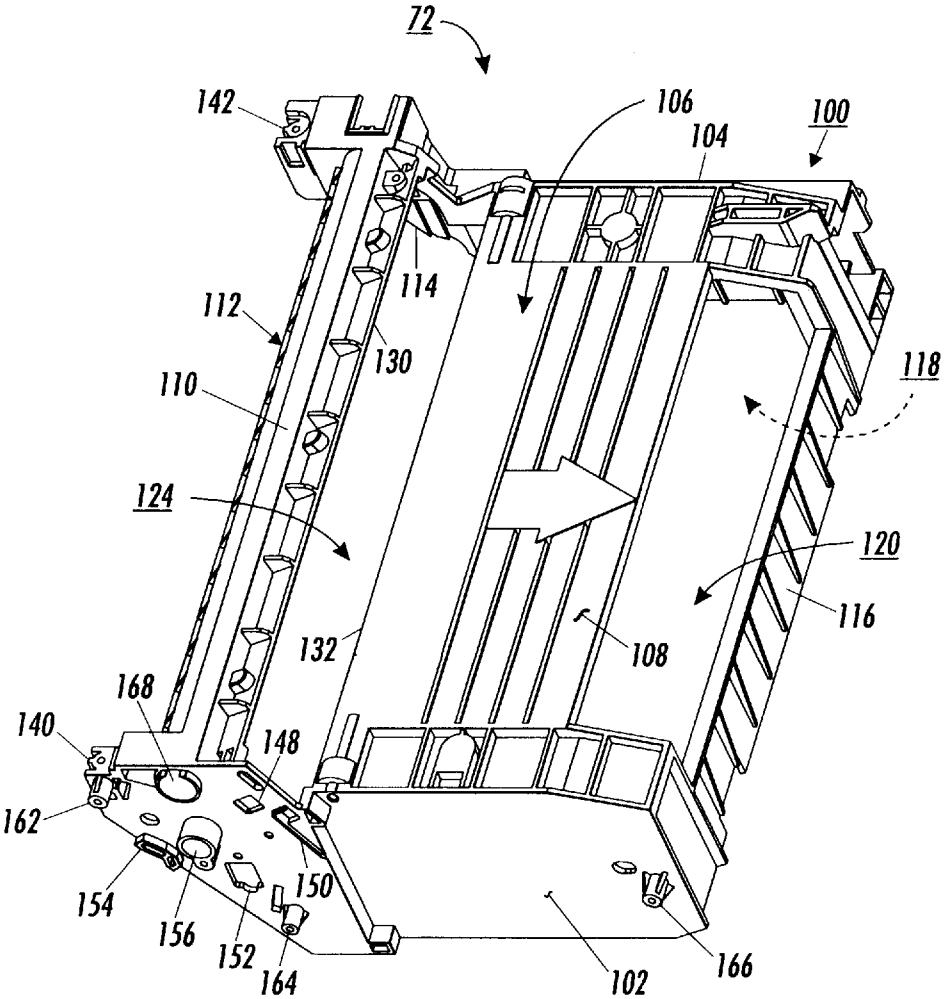
FIG. 2 is a top perspective view of the module housing of the CRU or process cartridge module of the machine of FIG. 1.
Figure 3:
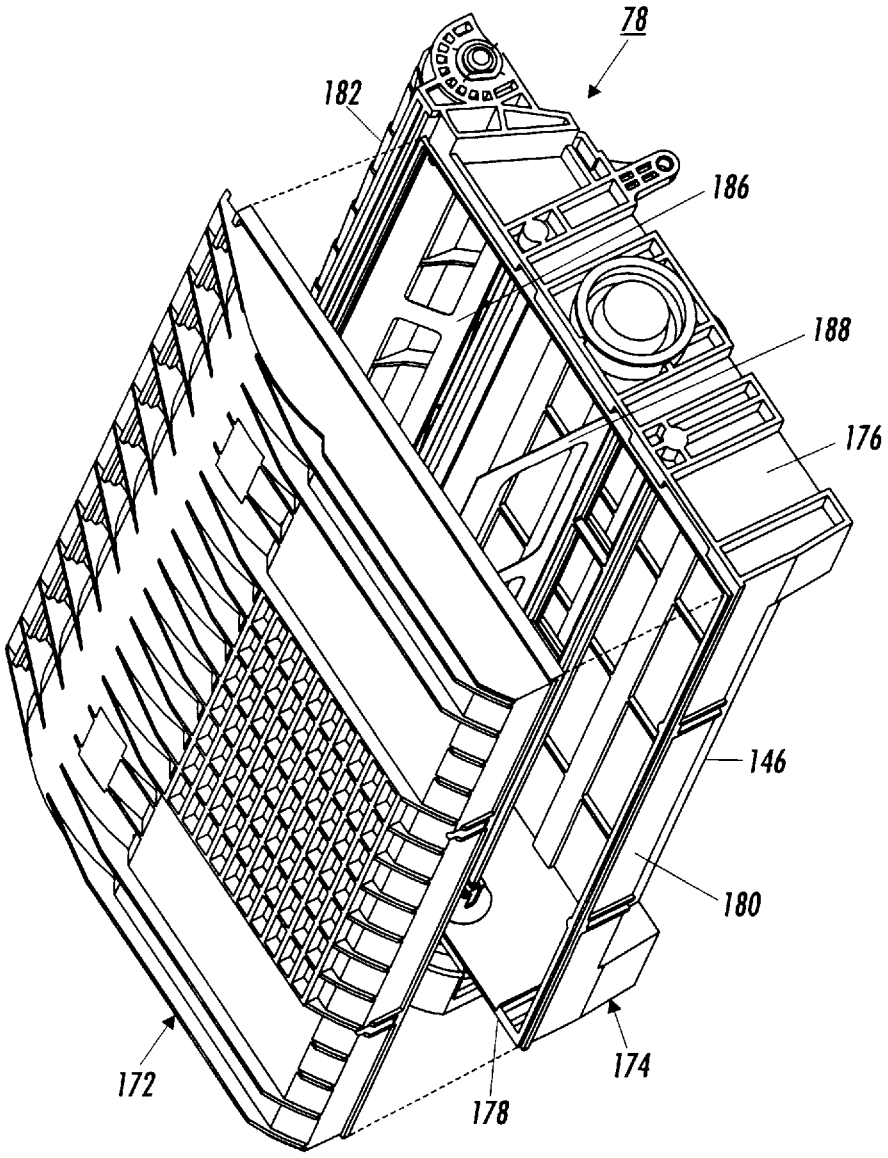
FIG. 3 is a bottom perspective view of the developer subassembly of the CRU or process cartridge module of the machine of FIG. 1 with the bottom of the developer housing unattached.

Referring now to FIGS. 1–6, the module housing subassembly 72 is illustrated (FIG. 2). As shown, it comprises a generally rectangular and inverted trough shaped module housing 100 having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106. The trough shaped module housing 100 of course, has no bottom wall, and hence as inverted, it defines a trough region 118 that is wide open for assembling the developer subassembly 78 (FIG. 3). The top wall 106 and the front end wall 116 each include a first cutout 120 formed through their adjoining corner for partially defining a first light path 122 (FIG. 1) for the exposure light 88 from the ROS 38 of the imager module 32. The top wall 106 also includes a second cutout 124 formed there into at the adjoining angle between the horizontal 108 and near vertical 110 portions thereof for mounting the charging subassembly 76 (FIG. 5), and for partially defining a second light path 126 (FIGS. 1 and 6) for an erase light 128 being focused into the photoreceptor area at the raised rear end 112 of the module housing 100.

Importantly, the module housing 100 includes two top wall cross-sectional surfaces 130, 132 defining the second cutout 124, and one 130, of these cross-sectional wall surfaces, has a desired angle 134 (relative to the photoreceptor surface) for mounting and setting a cleaning blade 138 (FIG. 6) of the cleaning subassembly 80. Attachment members 140, 142 are provided at the raised rear end 112 and extending from the first and second side walls 102, 104 respectively, for attaching a module handle 144 to the module housing 100.

As pointed out above, the module housing 100 is the main structure of the all-in-one CRU or process cartridge module 44, and importantly supports all other subassemblies (cleaning subassembly 80, charging subassembly 76, developer subassembly 78, and sump subassembly 82) of the all-in-one process cartridge module 44. As such, it is designed for withstanding stresses due to various dynamic forces of the subassemblies, for example, for providing a required re-action force to the developer subassembly 78. Because it is located just about 3 mm below the fuser module 46, it is therefore made of a plastic material suitable for withstanding relatively high heat generated from the fuser module. Mounts (not shown) to the developer subassembly within the trough portion of the module housing subassembly are located such that the top wall 106 of the module housing defines a desired spacing comprising the first light path 122 between it and the top 146 of the developer subassembly. Similarly, the raised rear end 112 of the top wall 106 of the module housing is also such as to define a desired spacing between the charging subassembly 76 and the photoreceptor or drum 84, when both are mounted to the raised rear end 112 of the module housing 100. Additionally, the module housing 100 provides rigidity and support to the entire process cartridge module 44, and upon assembly mutually self-aligns the CRU or process cartridge module 44 relative to abutting modules such as the CIM 22, and ECS/PS module 30.

Figure 5:
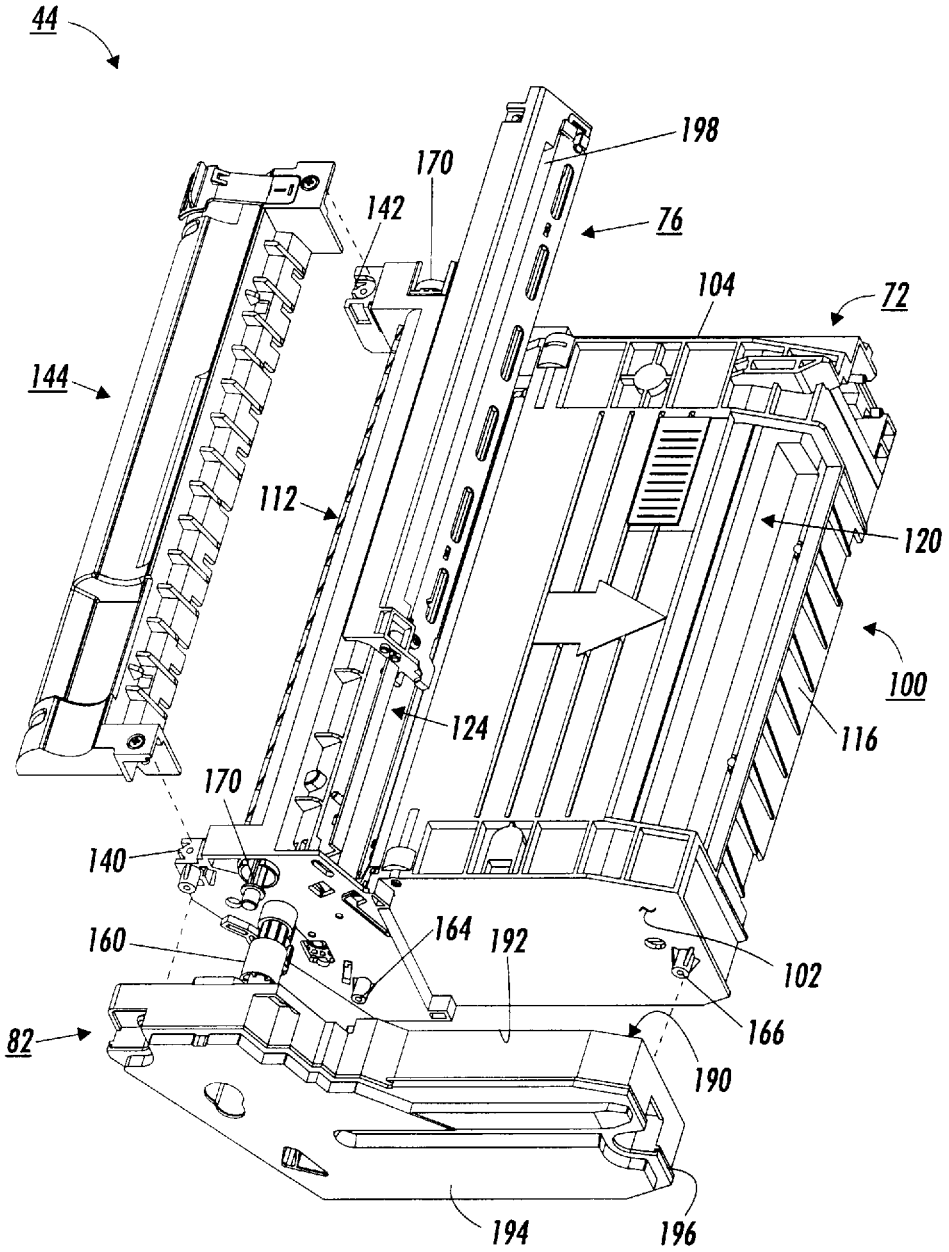
FIG. 5 is an exploded view of the various subassemblies of the CRU or process cartridge module of the machine of FIG. 1.

Referring in particular to FIG. 2, the first side wall 102 includes electrical connectors 148, 150 for supplying power from the ECS/PS module 30 (FIG. 1) via the sump subassembly 82 to the charging subassembly 76. It also includes an electrical connector 152 for supplying an electrical bias to the developer subassembly 78, as well as an alignment member 154 for aligning the detack device 68 (FIG. 1) to the photoreceptor. As also shown, the first side wall 102 further includes an apertured retainer device 156 for receiving an electrical grounding pin 160 for the photoreceptor 84. Importantly, the first side wall 102 further includes mounting members 162, 164, 166 for mounting the sump subassembly 82 to the module housing 100, and an opening for mounting an auger 170 of the cleaning subassembly 80 (FIGS. 1 and 5). The opening 168 also passes waste toner received from the photoreceptor 84 in the raised rear end 112, into the sump assembly 82, when mounted as above.

Referring now to FIG. 3, the developer subassembly 78 of the process cartridge module 44 is illustrated with an expandable bottom member 172 unattached in order to reveal the inside of the developer subassembly. As shown, the developer subassembly 78 comprises a generally rectangular developer housing 174 having the bottom member 172, the top 146, a first side 176, a second and opposite side 178, a front end 180 (relative to cartridge insertion), and a rear end 182. The developer housing 174 is for containing developer material, such as, single component magnetic toner (not shown), and it additionally houses the magnetic developer roll 92 (FIG. 1), a development bias application device 184, and a pair of developer material or toner agitators 186,188.

Figure 4:
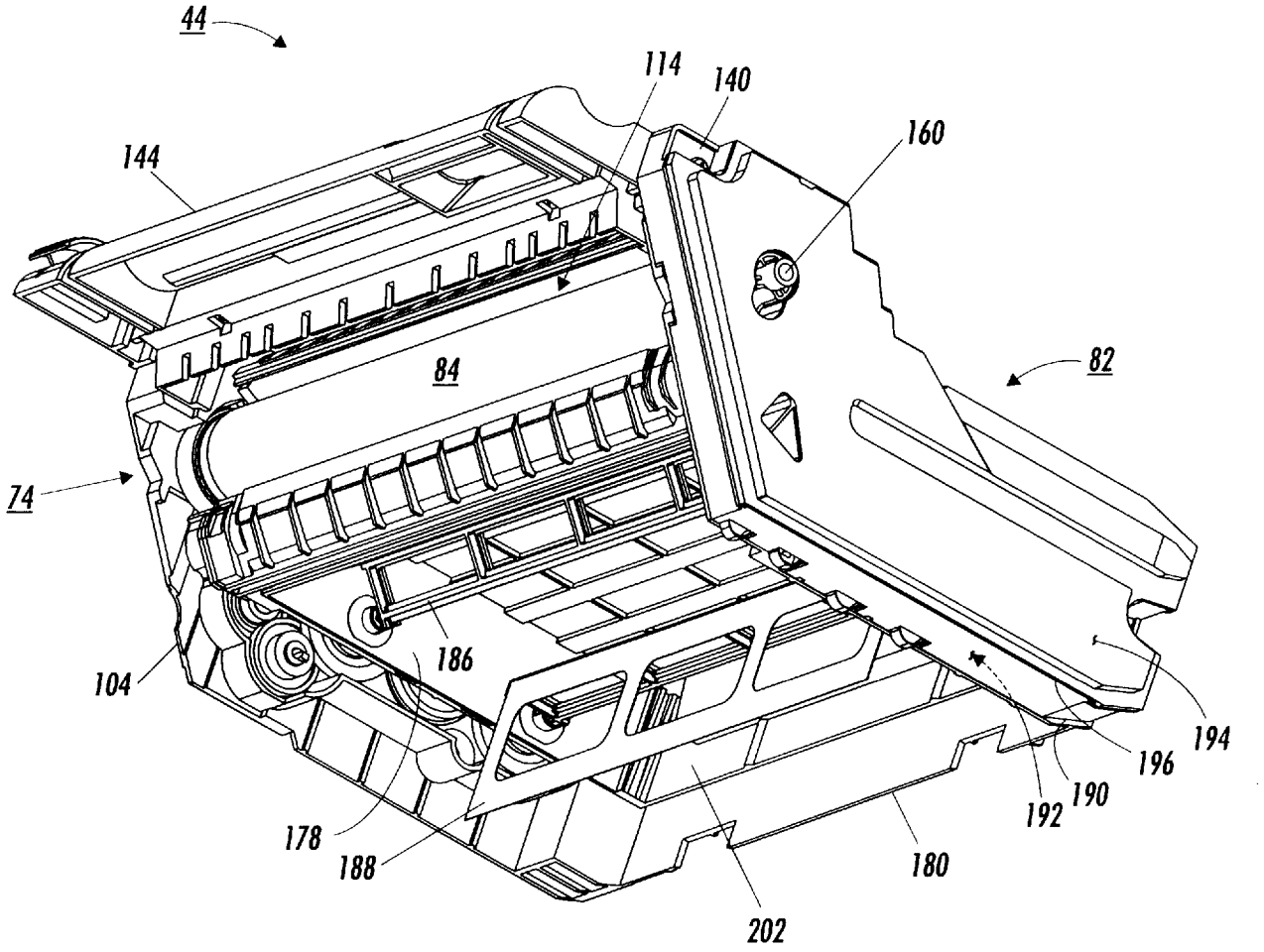
FIG. 4 is an open bottom perspective view of the CRU or process cartridge module of the machine of FIG. 1.

As shown in FIG. 4, the developer subassembly 78 is mounted to the module housing 100, and inside the trough region 118. With the bottom member 172 of the developer housing removed (for illustration purposes only), the agitators 186, 188 can clearly be seen. Also shown in FIG. 4 are the photoreceptor or drum 84 mounted within the raised rear end 112 of the module housing 100, as well as, the module handle 144 attached to the side walls 102, 104 at the raised rear end 112. The whole sump subassembly 82 is further shown with an outside surface 190 of its inside wall 192, mounted to the first side wall 102 of the module housing 100. The outside surface 194 of the outside wall 196 of the sump assembly is also clearly visible. The inside wall 192 and outside wall 196 partially define the sump cavity (not shown) for containing received waste toner, as above.

Referring now to FIG. 5, there is presented an exploded perspective view of the various subassemblies, as above, of the CRU or process cartridge module 44. As shown, the module handle 144 is attachable to mounting members 140, 142 at the raised rear end 112 of the module housing 100, and the sump subassembly 82 is mountable to the first side wall 102 of the cartridge housing. The developer subassembly 78 is mounted within the trough region 118 of the module housing 100, and is partially visible through the first cutout 120. Advantageously, the developer subassembly fits into the trough region 118 such that the top 146 (FIG. 3) of the developer subassembly and the inside of the top wall 106 of the module housing define the first light path 122 for the exposure light 88 from the ROS 38 (FIG. 1). As also shown, the charging subassembly 76 is mountable, at the second cutout 124, to the module housing 100, and includes a slit 198, through the charging subassembly, that defines part of the second light path 126 for the erase light 128 to pass to the photoreceptor 84.

Figure 6:
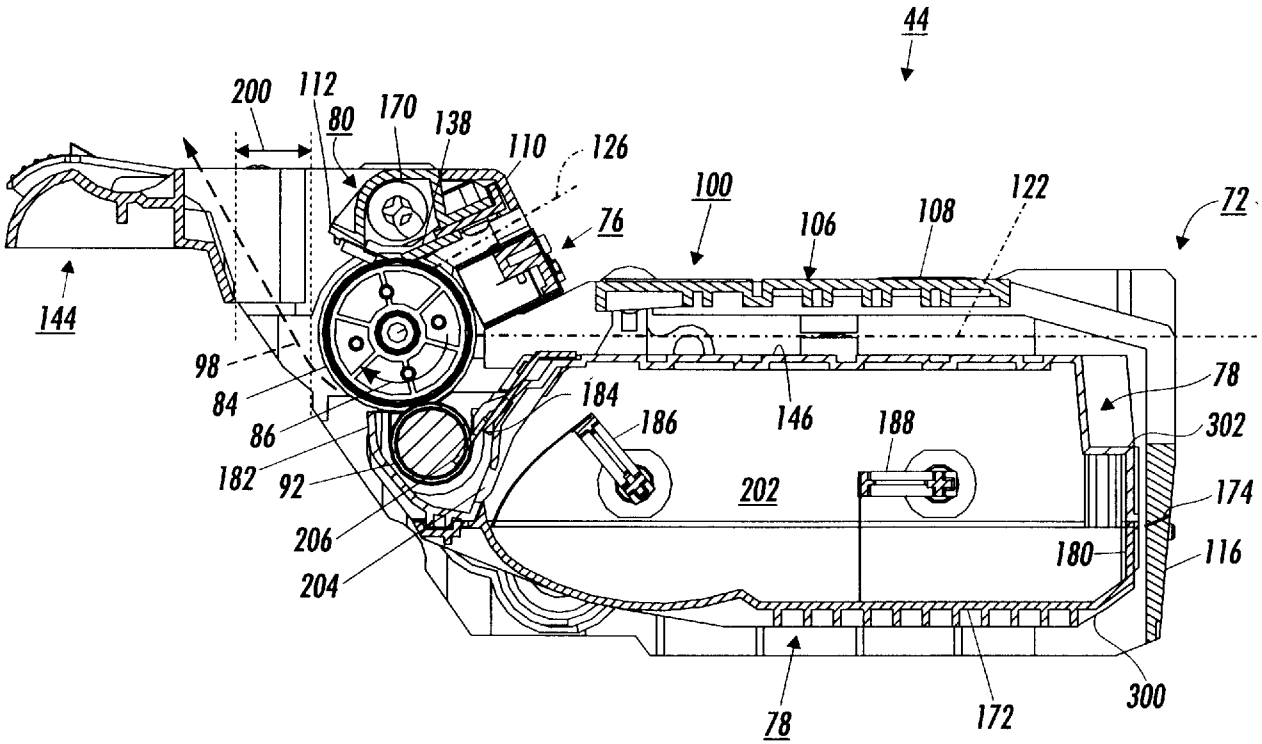
FIG. 6 is a vertical section (front-to-back) of the CRU or process cartridge module of the machine of FIG. 1.

Referring next to FIG. 6, a vertical (rear-to-back) section of the CRU or process cartridge module 44 as viewed along the plane perpendicular to the axis of the photoreceptor is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, (only one of which is visible), forms a portion of the sheet or paper path 98 of the machine 20 (FIG. 1) by being spaced a distance 200 from photoreceptor 84 in the raised rear end 112 of the module housing 100. The photoreceptor or drum 84 is mounted to the side walls 102, 104, (only one of which is visible), and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (FIG. 1). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

According to the present invention and referring to FIG. 6, a variable size development pan 300 is shown. The pan 300 and upper developer housing 302 are fitted together and form the toner development housing 174. The toner development housing 174 serves to support the development module 78. The development module 78 includes developer roll 92 as well as first and second toner agitator or paddles 188 and 186.

The development module 78 is mounted in process cartridge 72. The process cartridge 72 may be customer replaceable unit which is replaced with the development module 78.

Figure 7:
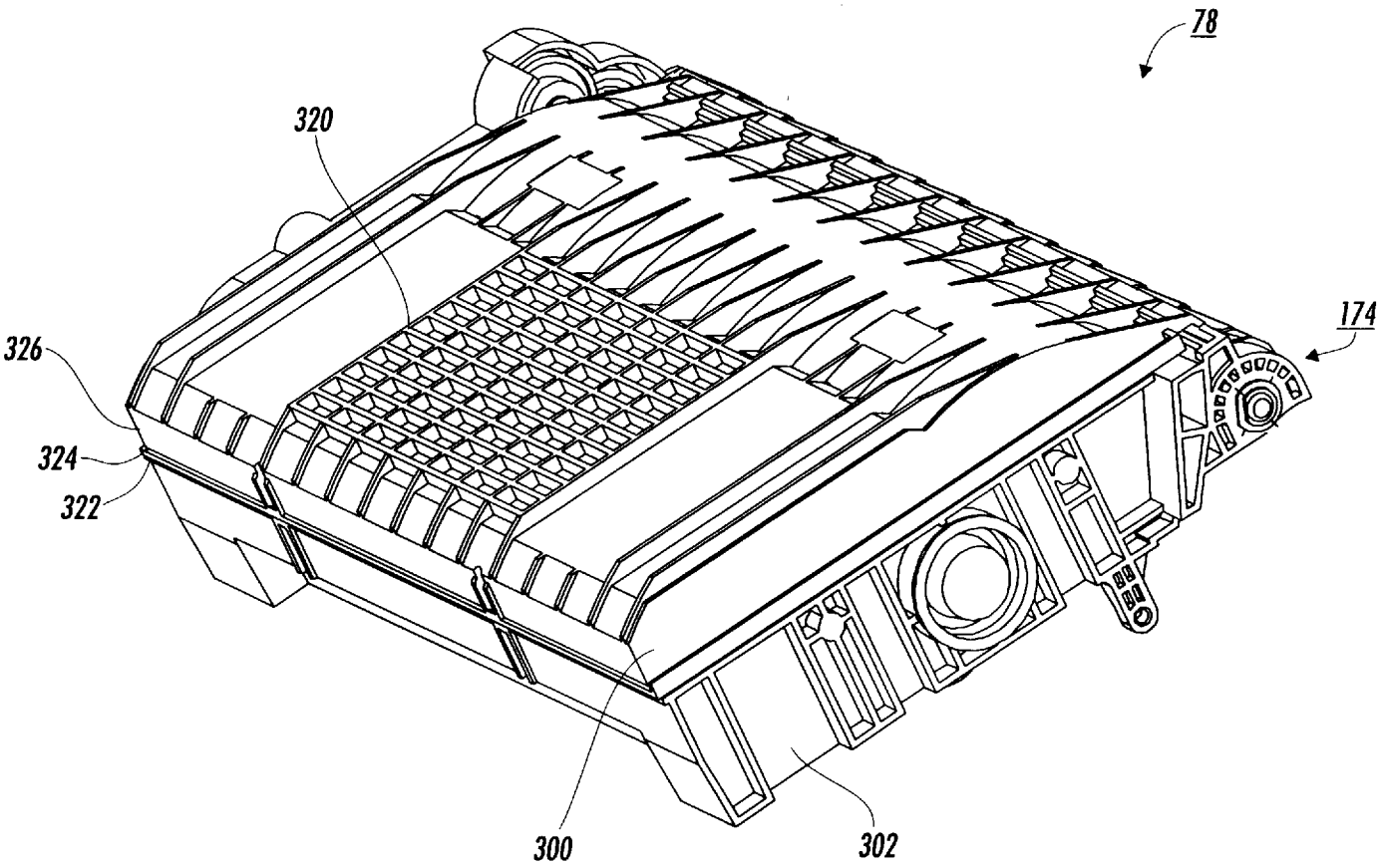
FIG. 7 is a perspective view of a variable size, replaceable toner sump pan installed on a developer module.

Referring now to FIG. 7, the pan 300 is shown in greater detail. The pan 300 may be made of any suitable durable material which is not chemically reactive with the toner to be used. Preferably, for simplicity and to promote recycling, the pan 300 is made of a similar material to that of upper development housing 302. For example, the pan 300 may be made of a plastic. For example, the pan may be made of acrylonitrile-butadiene-styrene copolymer (ABS) or high impact high polystyrene (HIPS).

The pan 300 may have any suitable shape and typically has a shape similar to that of the upper development housing 302 to which it is matingly fitted. For example, as shown in FIG. 7, the pan 300 may have a generally rectangular shape to optimize storing capacity within a given area. To improve the strength of the pan 300, the pan 300 may include ribs or reinforcements 320 which extend outwardly from the pan 300.

The pan 300 may be secured to the upper developer housing 302 in any suitable fashion. For example, as shown in FIG. 7, the upper developer housing 302 includes an upper development housing flange 322 which mates with pan flange 324 extending outwardly from outer periphery 326 of the pan 300. The flanges 322 and 324 provide for a contact surface to which the pan 300 may be secured to the upper developer housing 302.

Figure 8:
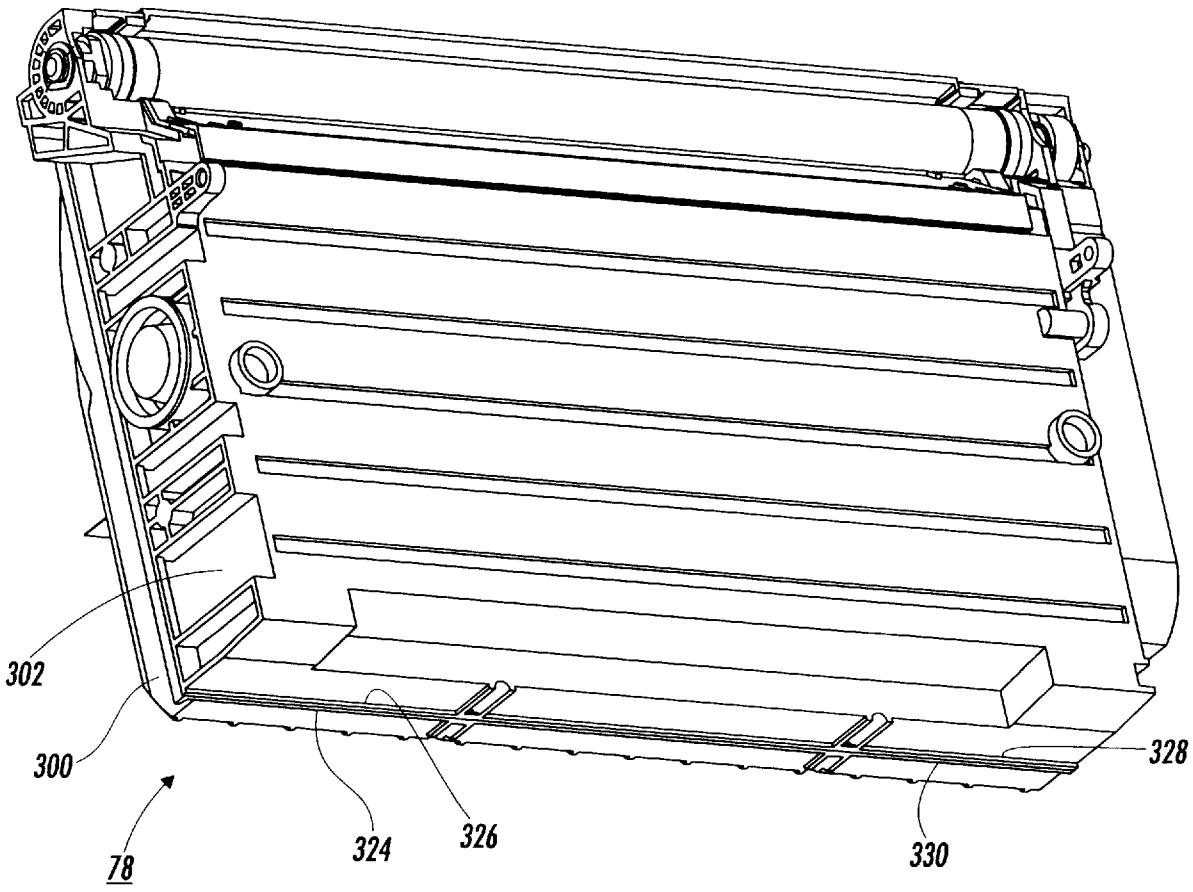
FIG. 8 is a perspective view of the opposite side of the developer module of FIG. 7 including the variable size, replaceable toner sump pan.

Referring now to FIG. 8, the flanges 324 and 326 of the pan and upper developer housing 302 are shown respectively. The pan flange 324 includes an outer face 328 which mates with outer face 330 of the upper developer housing flange 326.

The surface 328 and 330 may be joined by any suitable method. For example, the surfaces 328 and 330 may be glued or joined by fasteners. Preferably, however, the surfaces 328 and 330 are joined by vibration welding. Vibration welding provides for a low cost assembly, requires no fasteners, has a very low labor content, and does not include a glue which may be incompatible with the toner.

Referring now to FIG. 9, the interior of the pan 300 is shown in greater detail. Surface 328 of the pan flange 324 and inner periphery 332 of the pan 300 define a cavity 334 therebetween. The cavity 334 defines a volume V1 in which the marking particles may be stored.

Figure 10:
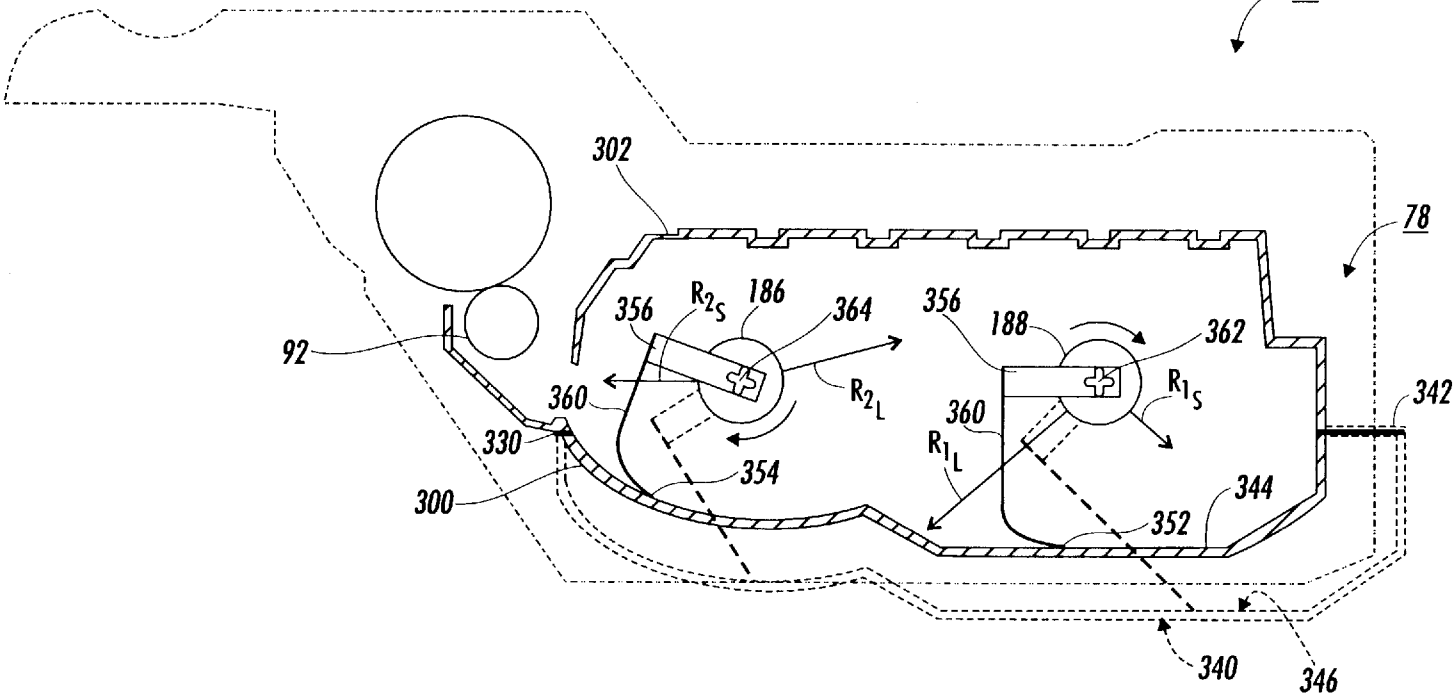
FIG. 10 is a sectional view of a process cartridge or CRU showing a small pan as well as a larger pan in phantom.

Referring now to FIG. 10, a second larger pan 340 is shown in phantom in position in the process cartridge 72. The second pan 186 is similar to first pan 300 except that second pan 300 is substantially larger than first pan 300. The second pan 300 is preferably made of the same material as the first pan 300, for example, of acrylonitrile-butadiene-styrene copolymer (ABS) or high impact high polystyrene (HIPS).

The second pan 340 includes a second pan flange 342 which mates with flange 330 of the upper developer housing 302. Thus, by removing the first pan 300 and replacing it in the process cartridge 72 with second pan 340, a process cartridge may be provided with a greater toner capacity.

The area between lower inner periphery 344 of the first pan 300 and lower inner periphery 346 of the second pan 340, defines a cavity 350 which has a volume V2. The second pan 340 thus may store a quantity of toner which is defined by the sum of the volume V1 of the first pan 300 plus the volume V2 defined between the peripheries 344 and 346.

As shown in FIG. 10, the additional volume of the second pan 340 may be provided by providing a pan which extends further downward in the vertical direction and by providing a pan which extends outward in a direction horizontal from the development roll 92.

To assure that the toner 351 within the development unit 78 is advanced toward the developer roll 92, an urging device is required to urge the marking particles toward the development roll 92. It should be appreciated that if the development roll 92 is positioned in the lower most point of the developer unit, gravity may provide the urging means.

As shown in FIG. 10, the development unit 78 includes first and second paddles or agitators 188 and 186. The paddles 188 and 186 serve to urge the marking particles 351 toward the development roll 92. It should be appreciated that while as shown in FIG. 10 two paddles 188 and 186 are used, a solitary paddle may be sufficient to advance the marking particles toward the developer roll.

As shown in FIG. 10, the paddles 188 and 186 include distal ends 352 and 354, respectively. The distal ends 352 and 354 contact the periphery 344 of the first pan 300 when it is in position in the development unit 78 and are also capable of contacting inner periphery 346 of the second pan 340 when the second pan 340 is alternately installed within the developer 78.

Since the second pan internal periphery 346 is further from the paddles 188 and 186 than the first pan inner periphery 344, the paddles 188 and 186 must be able to accommodate the different peripheries 344 and 346. One method of accommodating both peripheries 344 and 346 is to provide for flexible paddles for paddles 188 and 186.

As shown in FIG. 10, the paddles 188 and 186 have a first fixed arm portion 356 and a second flexible arm portion 360 extending from the distal end of the fixed arm portion 356. It should be appreciated that both arm portions 356 and 360 may be alternatively flexible.

It should be appreciated that distal end 352 of the first paddle 188 may be used to contact and clean an area along inner periphery 344 of the developer unit 78 having a distance from centerline 362 of the first paddle 188 a distance of anywhere from $_{R1S}$, the distance from centerline 362 to the distal end of fixed arm portion 356, to $R_{1L}$, the distance from the centerline 362 to distal end 352 of the first paddle 188. Similarly, the second paddle 186 may be used to contact inner periphery 344 or 346 of the pans 300 or 340 having a distance from the centerline 364 of the second paddle 186 a distance of anywhere from $R_{2S}$, the distance from centerline 364 to the distal end 354 of the fixed portion 356 to $R_{2L}$, the distance from centerline 364 to the distal end 352 of the second paddle 186. Thus, the paddles 188 and 186 serve to advance the marking particles 351 toward the developer roll 92 regardless of a wide variety of dimensions of the periphery of the pan.

Figure 11:
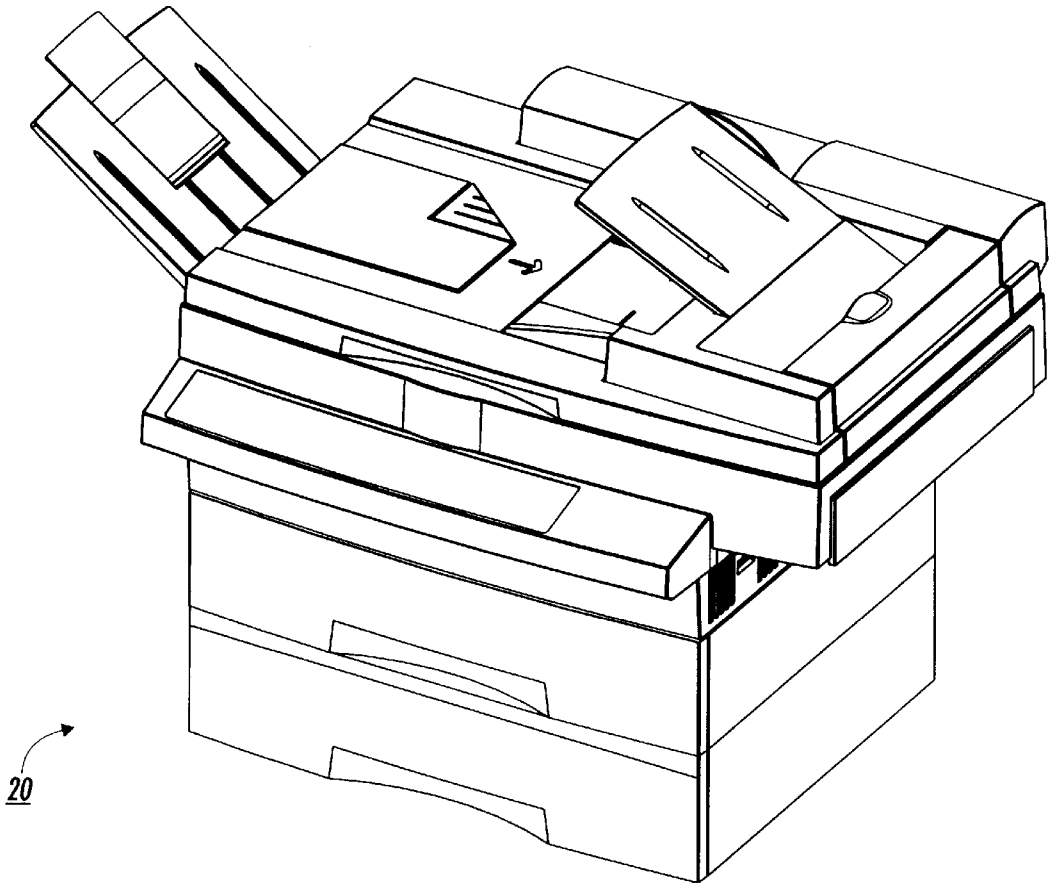
FIG. 11 is a perspective view of the machine of FIG. 1.

Referring now to FIG. 11, a printing machine incorporating the variable developer pan of the present invention is shown.

By providing a variable size developer pan, a plurality of printing cartridges may be provided with only a simple molded part to be changed.

By providing a variable size developer pan, changes may be made in the toner capacity of a printing cartridge very simply.

By providing a variable size developing pan, a variety of printing cartridges may be available for a printing machine with only the developer pan being different.

By providing a printing cartridge with a flexible toner agitator or paddle a variety of print cartridges may be provided with different toner capacities which may be utilized the common flexible agitators.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A system for providing a plurality of process cartridges for developing with marking particles a latent image with common components, said system comprising:

a housing;

a member mounted to said housing for advancing the marking particles toward the latent image;

a first pan securable to said housing and defining a first cavity therebetween, said first cavity defining a first volume;

a second pan securable to said housing and defining a second cavity therebetween, said second cavity defining a second volume substantially different than said first volume, said housing, said member and said first pan being assemblable to form a first process cartridge with said first volume and said housing, said member and said second pan being assemblable to form a second process cartridge with said second volume.

2. A system according to claim 1, wherein said member comprises a magnetic roll.

3. A system according to claim 1, wherein said member comprises a paddle.

4. A system according to claim 1, wherein said member is rotatably secured to said housing and defines a length outwardly from its axis of rotation to the distal end thereof, said member being flexible along its length so that the length of said arm is substantially greater than the distance from said axis of rotation to the inner surface of said first pan so that substantially all the marking particles may be removed from said first pan by the rotation of said member within said housing and so that when said second pan is secured to said housing substantially all the marking particles may be removed from said second pan by the rotation of said member within said housing.

5. A system according to claim 1:

wherein said housing defines a first planar surface; and wherein one of said first pan and said second pan defines a second planar surface, one of said first pan and said second pan being securable to said housing by securing said second planar surface to said first planar surface.

6. A system according to claim 5, wherein said first planar surface is glued to said second planar surface.

7. A system according to claim 5, wherein said first planar surface is welded to said second planar surface.

8. A process cartridge for providing marking particles to develop a latent image for use in an electrostatographic printing device, said process cartridge comprising:

a housing;

a member mounted to said housing for advancing the marking particles toward the latent image;

one of a first pan and a second pan, said first pan securable to said housing and cooperable with said housing to define a first cavity therebetween for storing the marking particles therein, said first cavity defining a first volume, said second pan securable to said housing and cooperable with said housing to define a second cavity therebetween for storing the marking particles therein, said second cavity defining a second volume substantially different than said first volume, the relative size and position of said housing, said member, said first pan and said second pan being selected so as to permit the process cartridge to advance the marking particles toward the latent image when either of said first pan and said second pan is utilized with said housing and said member.

9. A process cartridge according to claim 8, wherein said member comprises a magnetic roll.

10. A process cartridge according to claim 8, wherein said member comprises a paddle.

11. A process cartridge according to claim 8, wherein said member is rotatably secured to said housing and defines a length outwardly from its axis of rotation to the distal end thereof, said member being flexible along its length so that the length of said arm is substantially greater than the distance from said axis of rotation to the inner surface of said first pan so that substantially all the marking particles may be removed from said first pan by the rotation of said member within said housing and so that when said second pan is secured to said housing substantially all the marking particles may be removed from said second pan by the rotation of said member within said housing.

12. A process cartridge according to claim 8:

wherein said housing defines a first planar surface; and wherein one of said first pan and said second pan defines a second planar surface, one of said first pan and said second pan being securable to said housing by securing said second planar surface to said first planar surface.

13. A process cartridge according to claim 12, wherein said first planar surface is glued to said second planar surface.

14. A process cartridge according to claim 12, wherein said first planar surface is welded to said second planar surface.

15. An electrophotographic printing machine of the type including a process cartridge for providing marking particles to develop a latent image, said process cartridge comprising:

a housing;

a member mounted to said housing for advancing the marking particles toward the latent image;

one of a first pan and a second pan, said first pan securable to said housing and cooperable with said housing to define a first cavity therebetween for storing the marking particles therein, said first cavity defining a first volume, said second pan securable to said housing and cooperable with said housing to define a second cavity therebetween for storing the marking particles therein, said second cavity defining a second volume substantially different than said first volume, the relative size and position of said housing, said member, said first pan and said second pan being selected so as to permit the process cartridge to advance the marking particles toward the latent image when either of said first pan and said second pan is utilized with said housing and said member.

16. A printing machine according to claim 15, wherein said member comprises a magnetic roll.

17. A printing machine according to claim 15, wherein said member comprises a paddle.

18. A printing machine according to claim 15, wherein said member is rotatably secured to said housing and defines a length outwardly from its axis of rotation to the distal end thereof, said member being flexible along its length so that the length of said arm is substantially greater than the distance from said axis of rotation to the inner surface of said first pan so that substantially all the marking particles may be removed from said first pan by the rotation of said member within said housing and so that when said second pan is secured to said housing substantially all the marking particles may be removed from said second pan by the rotation of said member within said housing.

19. A printing machine according to claim 15:

wherein said housing defines a first planar surface; and wherein one of said first pan and said second pan defines a second planar surface, one of said first pan and said second pan being securable to said housing by securing said second planar surface to said first planar surface.

20. A printing machine according to claim 19, wherein said first planar surface is glued to said second planar surface.

21. A printing machine according to claim 19, wherein said first planar surface is welded to said second planar surface.

* * * * *

UNITED STATES PATENT AND TRADEMARK OFFICE
CERTIFICATE OF CORRECTION

PATENT NO. : 5,826,132

DATED : October 20, 1998

INVENTOR(S) : Damji et al.

It is certified that error appears in the above-identified patent and that said Letters Patent is hereby corrected as shown below:

Title page, after [22] Filed:, delete "Nov. 17, 1997" and insert --Nov. 14, 1997--.

Signed and Sealed this

Ninth Day of March, 1999

*Attest:*

*Attesting Officer*

Q. TODD DICKINSON

*Acting Commissioner of Patents and Trademarks*